United States Patent [19]

Trotta

[11] 4,411,065

[45] Oct. 25, 1983

[54] SHAVING CARTRIDGE ASSEMBLY

[75] Inventor: Robert A. Trotta, Pembroke, Mass.

[73] Assignee: The Gillette Company, Boston, Mass.

[21] Appl. No.: 352,150

[22] Filed: Feb. 25, 1982

[51] Int. Cl.[3] ..... B26B 21/14

[52] U.S. Cl. ..... 30/47

[58] Field of Search ..... 30/85, 47, 50, 51, 32, 30/329, 332, 335

[56] References Cited

U.S. PATENT DOCUMENTS

| | | | |
|---|---|---|---|
| 1,048,154 | 12/1912 | Harley | 30/89 X |
| 1,824,203 | 9/1931 | Fisher | 30/47 |
| 1,864,995 | 6/1932 | Frost | 30/32 |
| 2,421,540 | 6/1947 | Clarke | 30/47 |
| 2,654,148 | 10/1953 | Robinson | 30/32 |
| 3,274,683 | 9/1966 | Sachs | 30/51 |
| 3,378,922 | 4/1968 | Schrader | 30/32 |
| 3,409,982 | 11/1968 | Baker | 30/47 |
| 3,967,375 | 7/1976 | Hoffschmidt | 30/47 |

FOREIGN PATENT DOCUMENTS

| | | |
|---|---|---|
| 905581 | 3/1954 | Fed. Rep. of Germany . |
| 1753939 | 4/1957 | Fed. Rep. of Germany . |
| 2720180 | 11/1978 | Fed. Rep. of Germany . |

*Primary Examiner*—Jimmy C. Peters

*Attorney, Agent, or Firm*—Scott R. Foster

[57] ABSTRACT

A shaving cartridge assembly comprising a platform portion, a cap portion, blade means disposed between the cap and platform portions, and a housing portion having an opening at one end thereof, the housing portion being adapted to receive a handle member substantially axially of the housing for connecting the assembly to the handle.

7 Claims, 6 Drawing Figures

SHAVING CARTRIDGE ASSEMBLY

BACKGROUND OF THE INVENTION

1. Field of the Invention

The invention relates to wet shaving systems and is directed more particularly to a cartridge, or blade unit, for a shaving system, the cartridge being of the type having a blade element permanently secured between platform and cap portions.

2. Description of the Prior Art

Shaving cartridges having blade elements permanently secured therein are well known in the art. Examples of such cartridges may be found in U.S. Pat. Nos. 1,864,995—T. H. Frost; 2,654,148—W. M. Robinson; 2,676,397—J. De Bacco et al; 3,388,831—B. S. Hansom; 3,660,893—N. C. Welsh; 3,703,764—R. L. Perry; 3,783,510—J. Dawidowicz; and 4,026,016—W. I. Nissen.

Several structures for interconnecting such cartridges and complimentary handles have been disclosed. For example, in Robinson, Perry and Dawidowicz, a slide arrangement is utilized, in Frost a screw connection is shown, in De Bacco and Hansom a cartridge is held between jaws; in Nissen a pivotal connection is disclosed.

SUMMARY OF THE INVENTION

An object of the invention is to provide a shaving cartridge having as an integral portion thereof means for rapidly and securely connecting the cartridge to a handle member.

With the above and other objects in view, as will hereinafter appear, a feature of the present invention is the provision of a shaving cartridge assembly comprising a platform portion, a cap portion, blade means disposed between the cap and platform portions, and a housing portion having an opening at one end thereof, the housing portion being adapted to receive a handle member substantially axially of the housing for connecting the assembly to the handle, and detent means extending inwardly of the opening from interior wall means of the housing portion, the detent means being adapted to snap into corresponding recess means on the handle.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
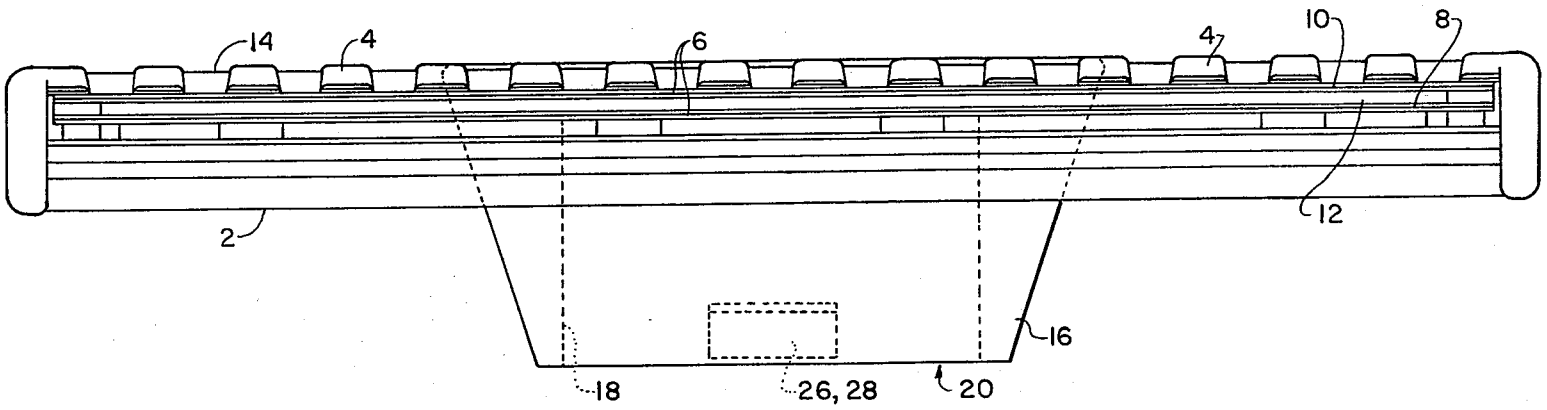
FIG. 1 is a front elevational view of one form of shaving cartridge illustrative of an embodiment of the invention.

Referring to the drawings, it will be seen that the illustrative shaving cartridge includes a platform portion 2, a cap portion 4, and blade means 6 disposed between the cap and platform portions. The cap and platform portions are preferably of molded plastic and of unitary construction. The blade means preferably includes first and second blade members 8, 10 with a spacer member 12 disposed therebetween.

The illustrative cartridge includes a back portion 14 interconnecting the platform and cap portions 2, 4. A housing portion 16 extends from the back portion 14 and may be defined in part by the back portion 14, as in FIGS. 4 and 5. The housing portion 16 defines a cavity 18 having an opening 20 at one end of the housing portion.

Figure 2:
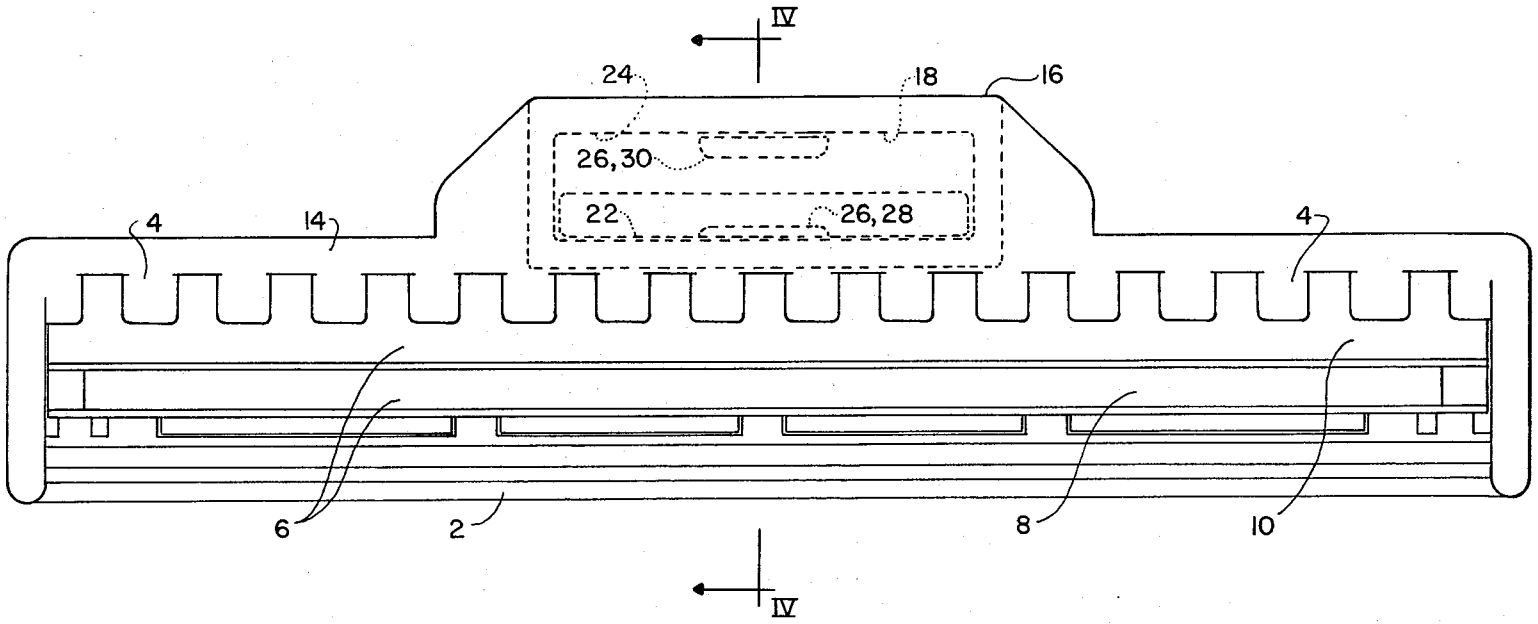
FIG. 2 is a top plan view thereof.
Figure 3:
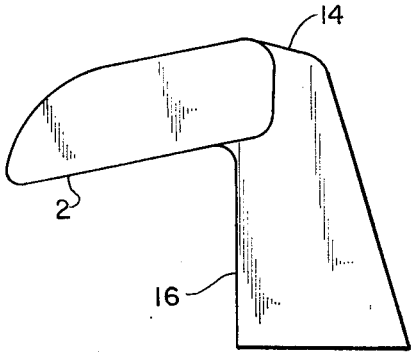
FIG. 3 is a side elevational view thereof.
Figure 4:
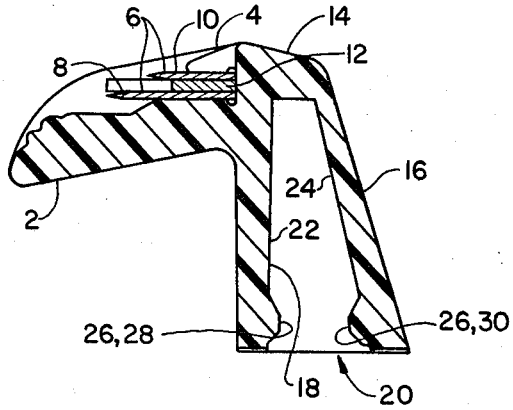
FIG. 4 is a sectional view taken along line IV—IV of FIG. 2.
Figure 5:
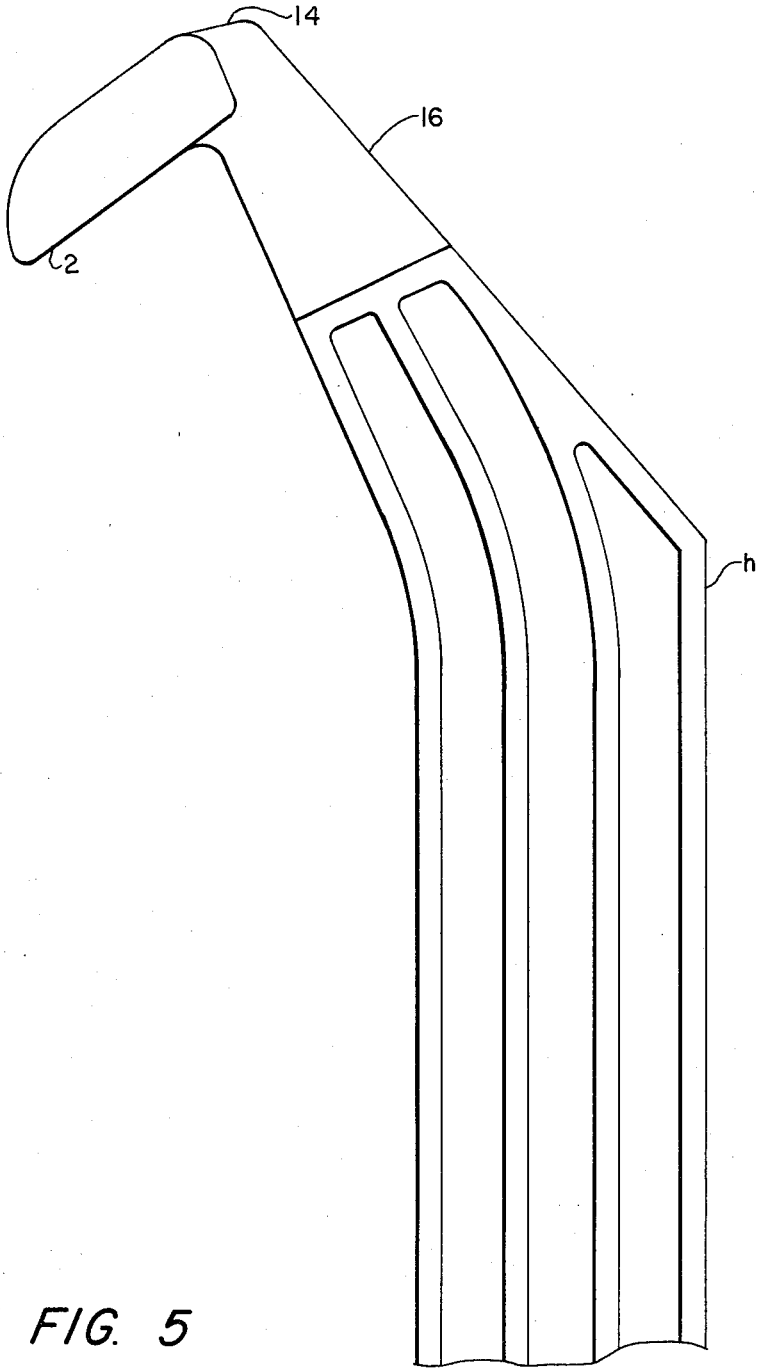
FIG. 5 is similar to FIG. 3, but shows an illustrative handle member connected to the shaving cartridge.
Figure 6:
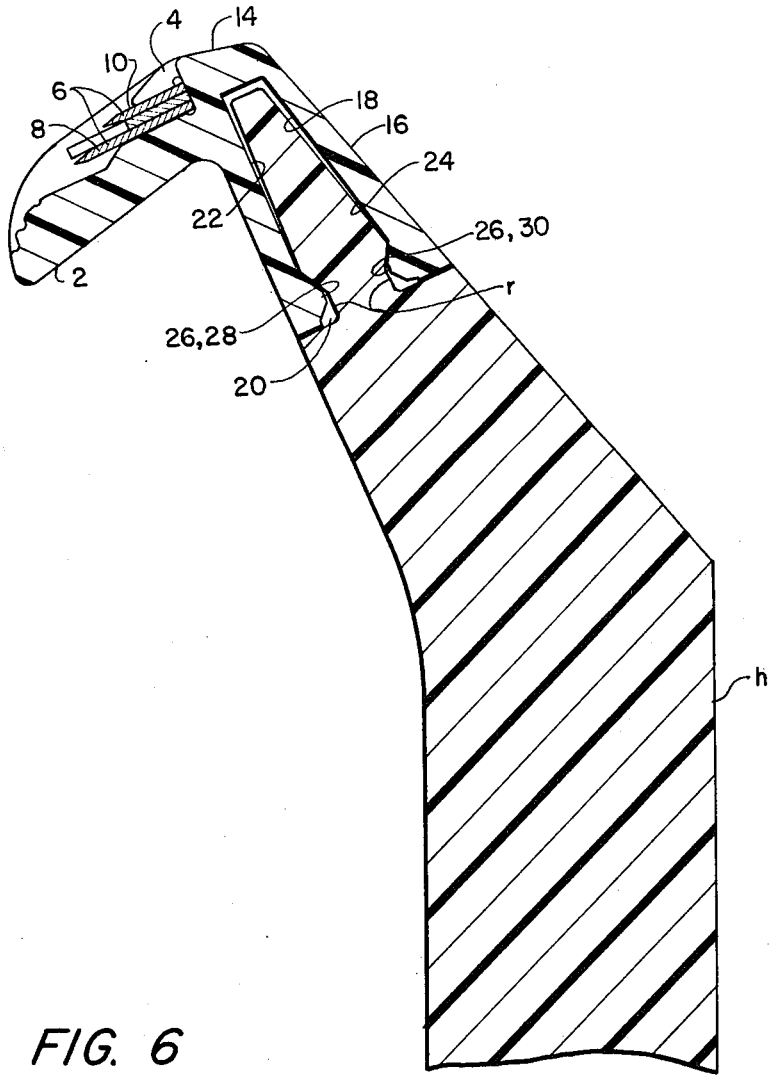
FIG. 6 is a sectional view, similar to FIG. 4, but shows the illustrative handle in section connected to the shaving cartridge.

Extending inwardly of the opening 20 from interior walls 22, 24 of the housing are friction engagement means, such as detent means 26, preferably in the form of opposed detents 28, 30 (FIGS. 2, 4, 5). Preferably the back portion 14 and housing portion 16, including the detents 28, 30, are molded unitarily with the platform and cap portions of a plastic material.

Referring to FIG. 5, it will be seen that the detents 28, 30 are adapted to snap into complementarily shaped friction engagement means, such as recesses r, on a handle h, to lock the cartridge on the handle. The molded plastic housing is sufficiently resilient to permit the detents to override portions of the handle to snap into the recesses r.

It is to be understood that the present invention is by no means limited to the particular construction herein disclosed and/or shown in the drawings, but also comprises any modifications or equivalents within the scope of the disclosure.

Having thus described my invention what I claim as new and desired to secure by Latters Patent of the United States is:

1. A shaving cartridge assembly comprising a platform portion, a cap portion, blade means disposed between said cap and platform portions, a back portion interconnecting said cap and platform portions, and a housing portion defined in part by said back portion and extending therefrom, said housing portion having an opening at one end thereof, said housing portion being adapted to receive a handle member substantially axially of said housing for connecting said assembly to said handle, and detent means extending inwardly of said opening from interior wall means of said housing portion, said detent means being adapted to snap into corresponding recess means on said handle.

2. The invention in accordance with claim 1 in which said detent means includes opposed detents.

3. The invention in accordance with claim 2 in which said opposed detents are proximate said openings.

4. The invention in accordance with claim 1 in which said platform portion, said cap portion, said back portion, and said housing portion comprise a unitary molding.

5. The invention in accordance with claim 4 in which said molding is of a plastic material.

6. A shaving cartridge assembly comprising a platform portion, a cap portion, blade means disposed between said cap and platform portions, a back portion interconnecting said cap and platform portions, and a housing portion extending from said back portion and defining a cavity adapted to receive a handle member therein substantially axially of said cavity to connect said assembly to said handle, and detent means on interior walls of said housing and extending inwardly of said cavity, said detent means being adapted to snap into complementary recesses on said handle to lock said assembly on said handle, said platform, cap, back and housing portions of said assembly being molded integrally of plastic, whereby to impart sufficient resiliency to said housing to permit said detent means to override portions of said handle and to snap into said recesses.

7. A shaving cartridge assembly comprising a platform portion, a cap portion, blade means disposed between said cap and platform portions, a back portion interconnecting said cap and platform portions, and a housing portion extending therefrom and defining a cavity adapted to receive a handle member therein substantially axially of said cavity to connect said assembly to said handle, and friction engagement means on interior walls of said housing, said friction engagement means being adapted to snap into engagement with complementary friction engagement means on said handle to lock said assembly on said handle, said platform, cap, back and housing portions of said assembly being molded integrally of plastic, whereby to impart sufficient resiliency to said housing to permit said housing engagement means to override portions of said handle and to snap into engagement with said handle engagement means.

* * * * *